United States Patent [19]

Sironi

[11] Patent Number: 4,676,825

[45] Date of Patent: Jun. 30, 1987

[54] HOT METAL DESULPHURIZING AND DEPHOSPHORIZING PROCESS

[75] Inventor: Giovanni Sironi, Rome, Italy

[73] Assignee: Centro Sperimentale Metallurgico SpA, Rome, Italy

[21] Appl. No.: 877,428

[22] Filed: Jun. 23, 1986

[30] Foreign Application Priority Data

Jun. 21, 1985 [IT] Italy ..... 48257 A/85

[51] Int. Cl.[4] ..... C22B 7/00; C21C 7/02

[52] U.S. Cl. ..... 75/51.1; 75/24; 75/40

[58] Field of Search ..... 75/40, 51.1, 24

[56] References Cited

U.S. PATENT DOCUMENTS 3,326,671 6/1967 Worner ..... 75/40

*Primary Examiner*—Peter D. Rosenberg

*Attorney, Agent, or Firm*—Young & Thompson

[57] ABSTRACT

A process for continuous treatment of hot metal topped from a blast furnace is disclosed. The process involves the steps of deslagging the metal, flowing the deslagged metal along a launders and blowing treatment agents in powdered form in a gas jet into the hot metal as it flows along the launder, the treatment agents being lime, fluorite, iron oxide or sodium carbonate.

7 Claims, 1 Drawing Figure

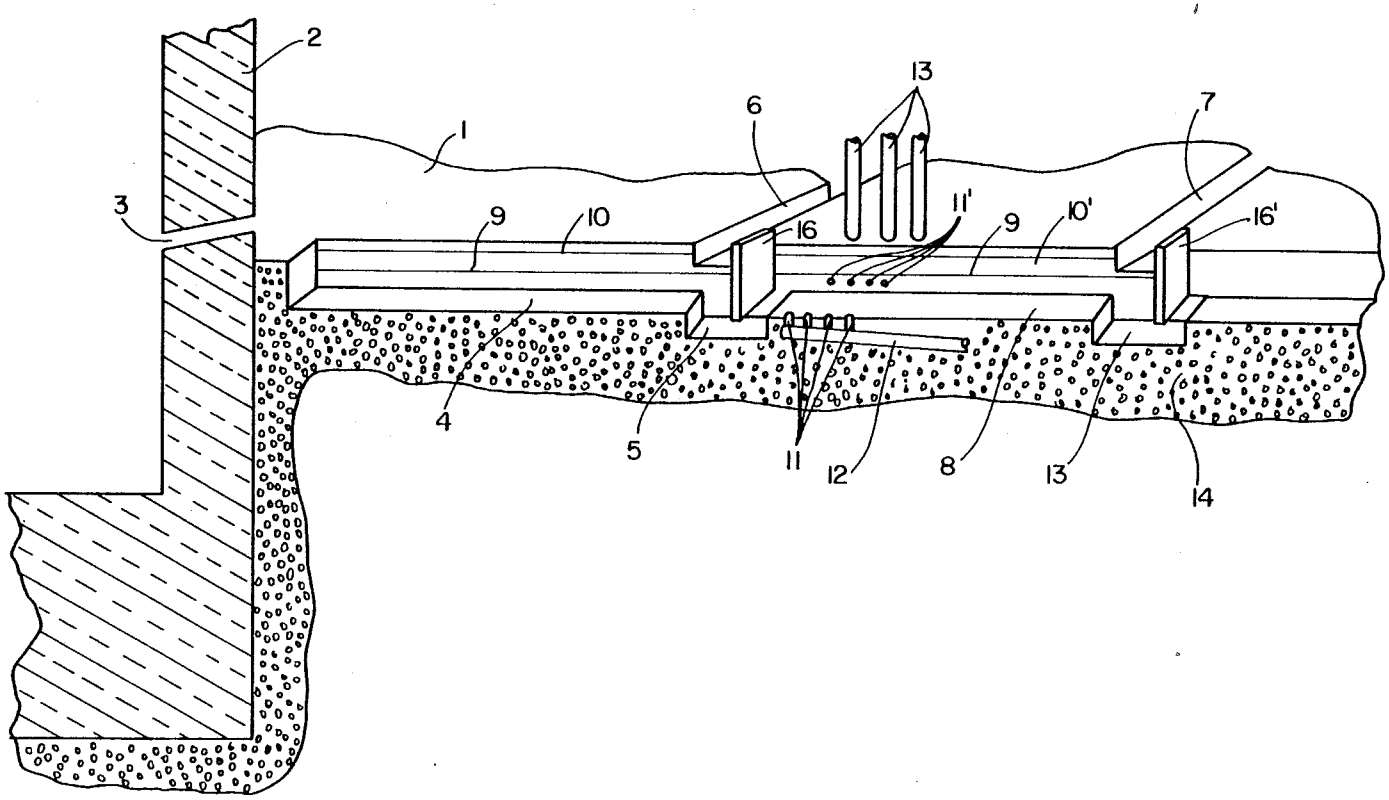
1
2
3
4
5
6
7
8
9
10
9
10'
11
11'
12
13
13
14
16
16'

HOT METAL DESULPHURIZING AND DEPHOSPHORIZING PROCESS

SUMMARY

When tapping the blast furnace the slagged hot metal is treated with solid or even gaseous agents to ensure good desulphurization and dephosphorization, for instance to permit mass production of microalloyed steels with high technological properties.

In this way it is possible to stay with the presently accelerating trend of regarding the converter simply as a decarburizing reactor, while performing all other treatments in the ladle before or after the converter. There are also major advantages compared with the known torpedo car treatments of hot metal.

DESCRIPTION

This invention concerns a process for desulphurizing and dephosphorizing hot metal. More precisely it concerns a continuous process for the treatment of hot metal as it is tapped from the blast furnace, after it has been deslagged and before it enters the torpedo car or is sent directly for refining. The rising costs of raw materials, energy and labour mean that all heavy industry must undertake major rationalization of operations. Integrated steelmaking, in this case, has decided to break down the relevant processes into a series of simple but connected and easily controllable operations. The converter, in particular, is coming to be used specifically as a highly-automated decarburizing reactor, all the other treatments being performed in the ladle.

The converter was conceived as a reactor to transform hot metal into steel. Its task was thus to eliminate from the hot metal not only carbon but also other elements such as silicon, sulphur, and phosphorus that might in any way lower the final quality of the steel.

It was subsequently realized, however, that some reactions, such as desulphurization and dephosphorization, were difficult to perform simultaneously in the converter. It has also been seen, more recently, that desiliconization can be advantageously avoided by producing low-silicon hot metal (generally $Si \leqq 0.20\%$) directly in the blast furnace.

As in-ladle treatments after the converter can be devoted more beneficially to metallurgical operations for ensuring final steel characteristics, it has been proposed that the hot metal be desulphurized and dephosphorized before it arrives in the steelmaking section.

Various materials and methods have thus been put forward for treating hot metal in the torpedo car. Yet despite some interesting applications, torpedo car treatment has a number of drawbacks such as, for instance, the need for specific, costly plants and the very frequent maintenance required on the torpedo car itself; the relative slowness of the operations themselves because of the large volume of hot metal that must be exposed to the reactions; and the well-known difficulty of separating slag, with the resulting possibility of the treatment being jeopardized because the residual slag may subsequently yield up part of its sulphur and phosphorus to the hot metal.

Last but not least, as treatment is done on a batch basis, there are difficulties in maintaining uniformity of treated hot metal quality.

The present invention is designed to overcome these drawbacks by providing a simple treatment process that ensures rapid action on hot metal composition and temperature.

The process according to the invention is characterized by the fact that the hot metal tapped from the blast furnace and deslagged in the usual manner is continuously treated with agents while it flows towards the torpedo car or in any case towards its point of use.

Instead of the launder presently employed to transfer the hot metal from the slag separation pocket to the torpedo car, the present invention preferably provides for the use of a special movable, replaceable launder with a great number of holes or tuyeres in the bottom, preferably grouped in the first half of the launder. The hot metal flowing in this movable launder is subject to the action of numerous gas jets injected via the holes or tuyeres, and which may also entrain solid agents in powder form; said gas jets can also consist of agents in gaseous form.

Alternatively, said agents can be blown wholly or in part from above, via appropriate distributors or lances.

The solid agents are preferably selected from the group including lime, fluorite, iron oxides and mixtures thereof, sodium carbonate and other materials that favour desulphurization and dephosphorization reactions from the chemical and kinetic points of view. Anyway, any known material for use in the desired operations can be employed advantageously according to the present invention, in quantities that can be for example between 50 and 80 kg per ton of hot metal in the case of mixtures consisting essentially of lime and iron oxides.

The injected gas can either be quite simply the vehicle for conveying these solid agents, in which case it should preferably be an inert gas, such as nitrogen and/or argon; or else the gas can also be an agent, in which case it can contain one gas from the group that includes oxygen, air and combustion products, so as to regulate hot-metal temperature and more generally favour conditions for desulphurization and dephosphorization reactions.

By controlling and hence by regulating the hot-metal temperature, the quantity of agents added, as well as the flow rate of the hot metal in the launder, by altering its slope, for instance, the time the hot metal remains in the launder can be tailored to suit the required reaction times.

All process variables can be regulated so that the residence time of the hot metal in the launder, expected to be between five and fifteen minutes, depending on its dimensions and the blast-furnace tapping rate, is sufficient to permit satisfactory treatment in the great majority of cases.

Evaluations made on a simulation model and experimental data indicate that, starting from low-silicon ($\leqq 0.20\%$) hot metal containing 0.03% S and 0.13% P, a ten-minute treatment involving 50 kg of agents per ton of hot metal should ensure sulphur and phosphorus values of around 0.005% to 0.015% respectively.

The slag produced with the treatment as per this invention is separated from the hot metal simply by means of a slag pocket at the end of the treatment launder, like those used before the launder.

The accompanying drawing illustrates schematically a cross sectional view of the foundry of a blast furnace. In the FIGURE, only the lowest part 2, where the hot metal collects, is shown.

The ground floor 1 of the foundry contains a channel 4, through which flow hot metal and slag poured from casting holes 3 of the blast furnace. In channel 4, the lines 9 and 10 represent respectively the approximate levels of hot metal and of slag.

A first slag separation pocket 5 is provided, in which slag is separated from hot metal by a vertical wall 16. The slag then flows away through a channel 6.

Downstream from pocket 5, that is, to the right as seen in the FIGURE, the usual launder has been replaced by a launder 8, having a number of tuyeres 11 that open through its bottom, although the tuyeres could also be on a vertical side wall of the launder, as shown for example at 11', by being rotated 90° from their lowermost position and raised slightly above the floor of the launder. A conduit 12 supplies reactive material and carrier gas to the tuyeres 11 or 11'.

By blowing reactive material into the launder 8, the dephosphorization and desulphurization reactions take place, and a new slag forms. Lines 9 and 10' represent the approximate levels of the hot metal and the new slag, this new slag being separated from the hot metal in the second slag separation pocket 15, above which the vertical wall 16' performs the same function as wall 16 upstream therefrom. This new slag flows away in channel 7.

Alternatively, a plurality of lances 13 can be provided, to blow reactive materials and carrying gas into the material in launder 8, in lieu of tuyeres 11 or 11'.

The foundry floor is shown in cross section at 14 and can be packed earth.

Although this invention has been described specifically by reference to desulphurization and dephosphorization, it is evident that other operations, both chemical and physical, such as the temperature control referred to, can also be performed, while remaining within the bounds of the protection of rights it provides.

What is claimed is:

1. Process for continuous treatment of hot metal tapped from a blast furnace, comprising deslagging the metal, flowing the deslagged metal along a launder, and blowing treatment agents in powdered form in a gas jet into the hot metal as it flows along the launder, said treatment agents being selected from the group consisting of lime, fluorite, iron oxide and sodium carbonate.

2. Process as claimed in claim 1, and blowing the agents into the metal through holes in a wall of the launder in contact with the hot metal.

3. Process as claimed in claim 1, in which said agents are blown into the metal in jets of inert gas.

4. Process as claimed in claim 3, in which said jets also comprise, in addition to said inert gas, at least one reactive gas selected from the group consisting of air, oxygen and combustion products.

5. Process as claimed in claim 1, in which at least part of said agents is blown from above into the hot metal flowing in the launder.

6. Process as claimed in claim 1, in which said deslagging is performed by skimming the slag from the surface of the hot metal.

7. Process as claimed in claim 6, in which said skimming is performed upstream and downstream of said blowing.

* * * * *